US010300518B2

(12) United States Patent
Rogers

(10) Patent No.: US 10,300,518 B2
(45) Date of Patent: May 28, 2019

(54) TOOL HOLDERS USABLE WITH TOOLING HAVING DIFFERENT TANG STYLES AND/OR CONFIGURED WITH MECHANICALLY-ACTUATED CLAMP ASSEMBLY

(71) Applicant: Wilson Tool International Inc., White Bear Lake, MN (US)

(72) Inventor: Bryan L. Rogers, Forest Lake, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 582 days.

(21) Appl. No.: 14/877,353

(22) Filed: Oct. 7, 2015

(65) Prior Publication Data

US 2016/0346824 A1 Dec. 1, 2016

Related U.S. Application Data

(63) Continuation-in-part of application No. 14/723,249, filed on May 27, 2015, now Pat. No. 10,189,067.

(51) Int. Cl.

| | |
|---|---|
| ***B21D 37/04*** | (2006.01) |
| ***B21D 5/02*** | (2006.01) |
| ***B21D 37/06*** | (2006.01) |

(52) U.S. Cl.

CPC ..... *B21D 5/0236* (2013.01); *B21D 5/02* (2013.01); *B21D 37/04* (2013.01); *B21D 37/06* (2013.01)

(58) Field of Classification Search

CPC .... B21D 5/0236; B21D 5/0209; B21D 37/00; B21D 37/14; B21D 37/04; B21D 37/06; B29C 47/128

USPC ..... 72/481.6, 481.1, 481.2

See application file for complete search history.

(56) References Cited

U.S. PATENT DOCUMENTS

| | | | |
|---|---|---|---|
| 851,350 | A | 4/1907 | Frey |
| 4,315,425 | A | 2/1982 | Zbornik et al. |
| 4,534,203 | A | 8/1985 | Cros et al. |
| 5,121,626 | A | 6/1992 | Baldwin |
| 5,390,527 | A | 2/1995 | Kawano et al. |
| 5,511,407 | A | 4/1996 | Kawano et al. |

(Continued)

FOREIGN PATENT DOCUMENTS

| | | | |
|---|---|---|---|
| CN | 203236230 | U | 10/2013 |
| DE | 3932629 | A1 | 4/1990 |

(Continued)

OTHER PUBLICATIONS

International Patent Application No. PCT/US2016/034030, International Search Report and Written Opinion dated Jul. 19, 2016, 11 pages.

*Primary Examiner* — David B Jones

(74) *Attorney, Agent, or Firm* — Fredrikson & Byron, P.A.

(57) ABSTRACT

Tool holder designs are described. In some cases, the tool holder has a clamp assembly that can be used with tools having different tang styles. The tool holder in some cases has at least two differing tolerance areas provided therein, wherein the tolerance areas provide complementary tolerance to the design. In some cases, the tool holder can have a mechanically actuatable mechanism that functions with one or more internal components that limit adjustment of the mechanism to prevent damage to one or more of tool and the tool holder when securing the tool therein.

20 Claims, 9 Drawing Sheets

(56) References Cited

U.S. PATENT DOCUMENTS

| | | | | |
|---|---|---|---|---|
| 5,513,514 | A | 5/1996 | Kawano et al. | |
| 5,572,902 | A | 11/1996 | Kawano et al. | |
| 5,619,885 | A | 4/1997 | Kawano et al. | |
| 5,642,642 | A | 7/1997 | Kawano et al. | |
| 5,685,191 | A | 11/1997 | Kawano et al. | |
| 5,782,308 | A | 7/1998 | Latten et al. | |
| 5,794,486 | A | 8/1998 | Sugimoto et al. | |
| 6,003,360 | A * | 12/1999 | Runk | B21D 5/0236 72/389.3 |
| 6,138,492 | A | 10/2000 | Vining et al. | |
| 6,151,951 | A | 11/2000 | Kawano et al. | |
| 6,446,485 | B1 | 9/2002 | Tarasconi | |
| 6,606,896 | B2 | 8/2003 | Tarasconi | |
| 6,644,090 | B2 | 11/2003 | Gasparini | |
| 7,069,766 | B2 | 7/2006 | Hayashi et al. | |
| 7,096,708 | B2 | 8/2006 | Gascoin | |
| 7,296,457 | B2 | 11/2007 | Morehead | |
| 7,308,817 | B2 * | 12/2007 | Shimota | B21D 5/0209 72/481.1 |
| 7,343,774 | B2 | 3/2008 | Gascoin et al. | |
| 7,596,983 | B2 * | 10/2009 | Pabich | B29C 47/128 72/481.1 |
| 7,721,586 | B2 | 5/2010 | Pabich et al. | |
| 8,496,255 | B2 | 7/2013 | Rouweler | |
| 2002/0023477 | A1 | 2/2002 | Gianelli | |
| 2005/0178183 | A1 | 8/2005 | Johnson et al. | |

FOREIGN PATENT DOCUMENTS

| | | | |
|---|---|---|---|
| EP | 1449599 | A1 | 8/2004 |
| JP | H06-23436 | A | 2/1994 |
| WO | 2001039906 | A1 | 6/2001 |
| WO | 2012145781 | A1 | 11/2012 |

* cited by examiner

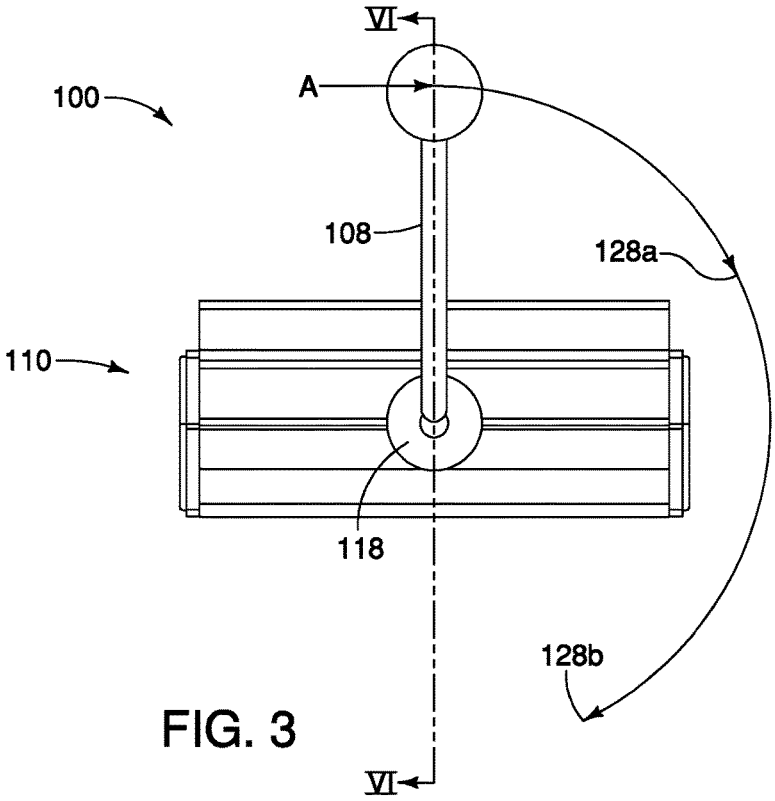
FIG. 3
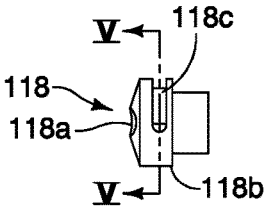
FIG. 5A
FIG. 5B
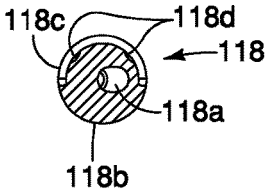
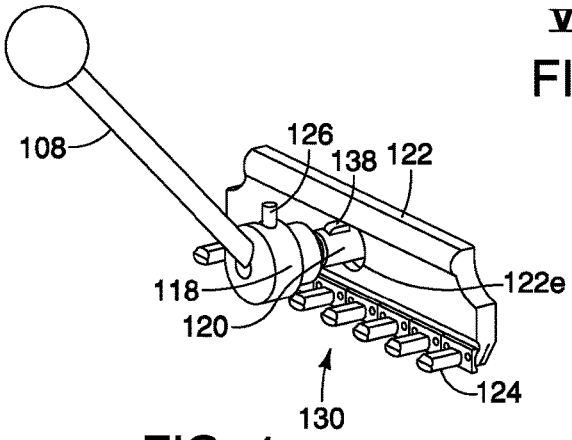
FIG. 4
FIG. 5C
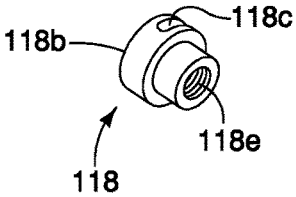

FIG. 19
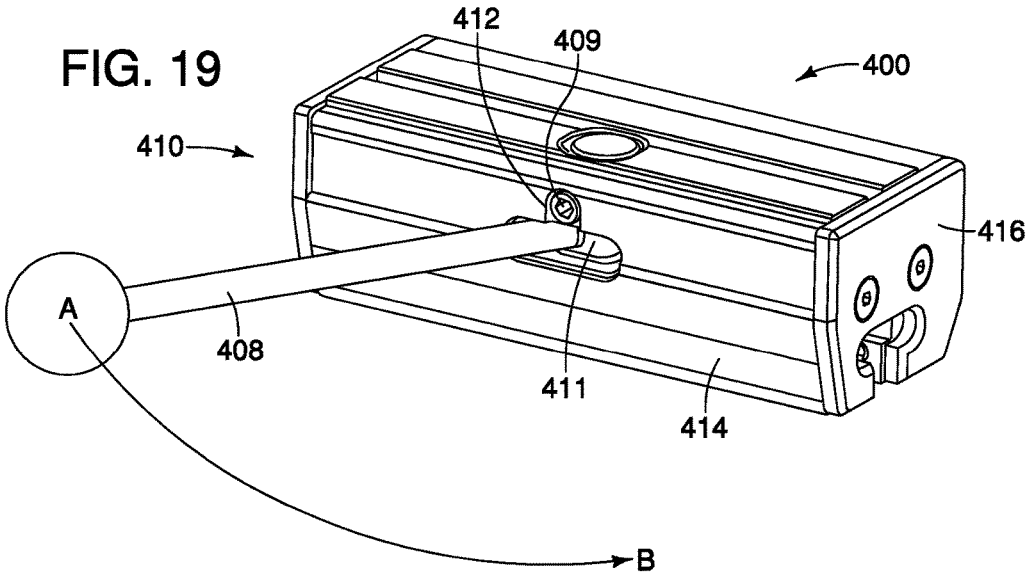
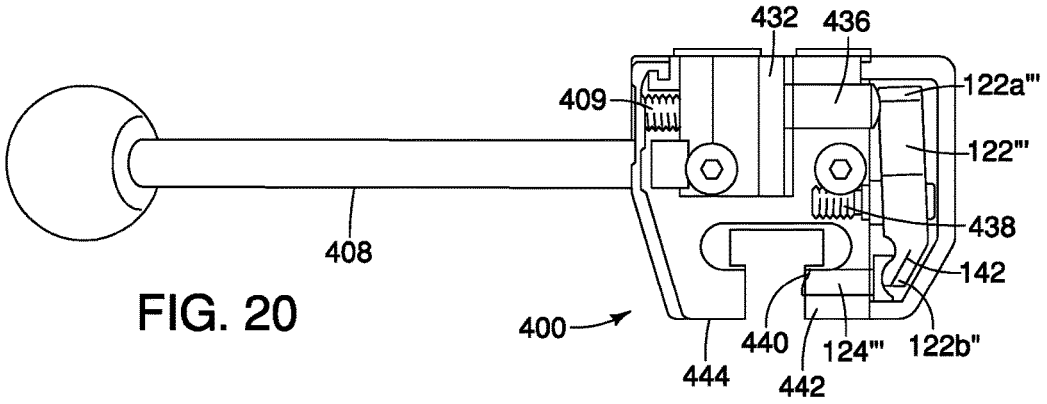
FIG. 20
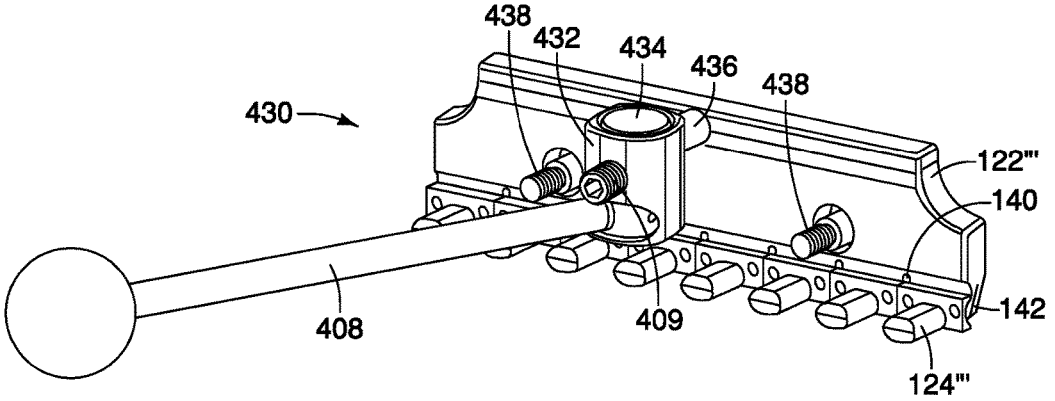
FIG. 21

TOOL HOLDERS USABLE WITH TOOLING HAVING DIFFERENT TANG STYLES AND/OR CONFIGURED WITH MECHANICALLY-ACTUATED CLAMP ASSEMBLY

FIELD OF THE INVENTION

The present invention relates generally to tool holders for use with industrial machines or equipment. More particularly, this invention relates to tool holders usable on press brakes, and assemblies of such tool holders for securing tools therewith.

BACKGROUND

Sheet metal and other workpieces can be fabricated into a wide range of useful products. The fabrication (i.e., manufacturing) processes commonly employed involve bending, folding, and/or forming holes in the sheet metal and other workpieces. The equipment used for such processes involve many types, including turret presses and other industrial presses (such as single-station presses), Trumpf style machines and other rail type systems, press brakes, sheet feed systems, coil feed systems, and other types of fabrication equipment adapted for punching or pressing sheet materials.

Concerning press brakes, they are equipped with a lower table and an upper table, and are commonly used for deforming metal workpieces. One of the tables (typically the upper table) is configured to be vertically movable toward the other table. Forming tools are mounted to the tables so that when one table is brought toward the other, a workpiece positioned there between can be formed, e.g., bent into an appropriate shape. Typically, the upper table holds a male forming tool (a punch) having a bottom workpiece-deforming surface (such as a V-shaped surface), and the bottom table holds an appropriately-shaped female tool (a die) having an upper surface vertically aligned with the workpiece-deforming surface of the male tool.

As is known, the forming tools are commonly mounted to press brake tables via use of one or more tool holders provided on the tables. Particularly, tangs or shanks of the tools are inserted between opposing portions of the holder that define a channel. Quite often, the channel is defined via a stationary portion of a first wall and a movable portion of an opposing second wall of the tool holder. As forming tools are available in a variety of shapes and sizes, the tangs for the tools also vary, particularly with regard to their profiles. One tang type (generally known as American style) has smooth, straight vertical sides extending upward from the tool body, and upon which the opposing portions of a tool holder contact when the tang is loaded there between. Other tang types (generally known as European or precision styles) have one or more grooves defined in their vertical sides, which in some cases are used in self-seating the tools when they are loaded between and subsequently contacted by the opposing portions of the tool holder.

Each tang style offers its own specific advantages. For instance, in utilizing straight style tangs, tooling is often found to be relatively easy to load and remove from tool holders, and more easily accommodated by differing makes of tool holders. On the other hand, in utilizing grooved style tangs, tooling can be more precisely held by tool holders (via seating mechanisms) so as to machine workpieces with high degree of accuracy. Traditionally, tool holders were designed to accommodate only one style of tool tang. However, this correspondingly limited the various tooling that could be used with such holders. Thus, the press brake industry started seeing the introduction of tool holder designs capable of being used with tools having different tang styles. However, such designs have not been without drawbacks.

For example, many of these tool holders have been designed to function with adaptors in accommodating different tang styles. With some designs, the adaptors dictate being changed out (in the case of multiple adaptors) or reoriented (in the case of a single adaptor) to accommodate the different tang styles. Unfortunately, the need for orienting the adaptor not only leads to corresponding downtime for the machine, but also introduces risk of improper orientation and corresponding production errors. Conversely, in other perhaps more conventional tool holder designs, instead of varying orientation of adaptors to accommodate different tang styles, the adaptors are held in a set orientation, and moved inwardly toward the tool tangs at different distances corresponding to the tang styles. However, such differing movements, and corresponding variances in force applied to accommodate such movements, typically dictates precise regulation of the force, or else damage can result to the tangs and/or the tool holders from contact there between. Such regulation has conventionally been provided via hydraulic, pneumatic, electric, or other like means, whereby the applied forces can be precisely administered, although incorporation of these elements adds complexity and overall cost to the designs.

One variable not yet described but given consideration in the design of tool holders is built-in tolerance. For example, there is generally a slight degree of variance with each tool and tool holder design, such as relating to general dimensions of the tool (e.g., its tang) or to actions of the tool holder (e.g., closing action(s) of one or more movable portions of the holder). By themselves, these variances can be deemed fairly negligible; however, they can present issues when encountered collectively, such as in the circumstance of loading forming tools in tool holders. For example, such variances can result in a corresponding degree of play for the tooling once loaded into the tool holders. To account for such variances, areas of tolerance have been provided in the tool holder designs. For example, tool holders have often been equipped with shape memory materials or structures such as springs to provide such areas of tolerance within the designs. However, even with the addition of such elements, issues of looseness or play between tool and holder can still be found to exist.

Thus, there remains a need for a tool holder design that accounts for the above-described issues as well as others, and in so doing to provide both an effective and efficient tool holder usable with tools having different tang styles.

SUMMARY OF THE INVENTION

Embodiments of the invention involve tool holder designs. In some cases, the tool holder has a clamp assembly that can be used with tools having different tang styles. The tool holder in some cases has at least two differing tolerance areas provided therein, wherein the tolerance areas provide complementary tolerance to the design. In some cases, the tool holder can have a mechanically actuatable mechanism that functions with one or more internal components that limit adjustment of the mechanism to prevent damage to one or more of tool and the tool holder when securing the tool therein.

In one embodiment, a tool holder is provided. The tool holder has a housing which defines a channel for receiving and retaining tool tangs therein; an actuator mechanism that is manually adjustable and accessible through the housing; and a clamp assembly operably coupled to the mechanism and comprising one or more clamping fingers. The one or more clamping fingers are movable to secure tools having different tang styles between the fingers and a stationary wall of the housing. Movement of the one or more clamping fingers corresponds to adjustment of the mechanism, wherein the mechanism is adjustable to a plurality of positions relative to the housing. Each of the positions correspond to a different setting for the clamping fingers relative to the stationary wall, wherein two or more of the positions each correspond to a different tang style of tool usable with the tool holder.

In another embodiment, a tool holder is provided. The tool holder has a housing which defines a channel for receiving and retaining tool tangs therein; a threaded insert that is manually rotatable and accessible through the housing; and a clamp assembly operably coupled to the insert and configured to secure tools having different tang styles between the clamp assembly and a stationary wall of the housing. Movement of the clamp assembly corresponds to rotation of the insert, wherein the insert is rotatable to a plurality of positions relative to the housing. Each of the positions correspond to a different setting for the clamp assembly relative to the stationary wall, wherein two or more of the positions each correspond to a different tang style of tool usable with the tool holder, and wherein the insert has a range of rotation to prevent excess rotation and corresponding damage to one or more of tools having different tang styles and the tool holder when securing the tools between the clamp assembly and the stationary wall.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

FIG. 3 is a front view of the tool holder of FIG. 1;

FIG. 4 is a perspective view of clamp assembly of the tool holder of FIG. 1 in accordance with certain embodiments of the invention;

FIGS. 5A, 5B, and 5C are side, cross-sectional, and perspective views of a clamping nut of the clamp assembly of FIG. 4 in accordance with certain embodiments of the invention, with FIG. 5B taken along the lines V-V in FIG. 5A;

FIG. 19 is a perspective view of a further tool holder in accordance with certain embodiments of the invention;

FIG. 20 is an internal side view of the tool holder of FIG. 19;

FIG. 21 is a perspective view of clamp assembly of the tool holder of FIG. 19 in accordance with certain embodiments of the invention;

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and other elements employ that which is known to those of ordinary skill in the field of the invention. Those skilled in the art will recognize that many of the noted examples have a variety of suitable alternatives.

Figure 1:
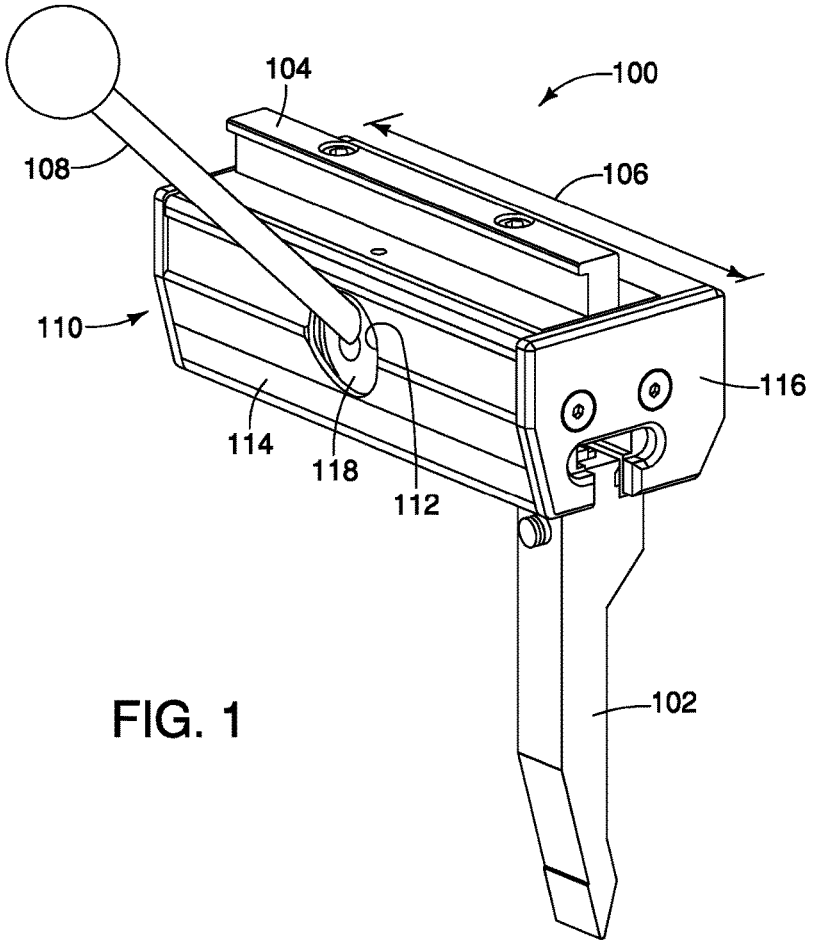
FIG. 1 is a perspective view of a tool holder in accordance with certain embodiments of the invention, wherein the tool holder is shown with exemplary forming tool loaded therein.

FIG. 1 shows a perspective view of a tool holder 100 in accordance with certain embodiments of the invention, wherein the holder 100 is depicted with exemplary forming tool 102 loaded therein. As shown (and similar to tool holders 200 of FIG. 10, 300 of FIG. 14, 400 of FIG. 19, and 500 of FIG. 22), the tool holder 100 is modular in design. Thus, while in certain embodiments, the holder 100 can be operatively coupled to a table (e.g., upper table) of a press brake machine (e.g., via elongated bar 104) or alternatively formed with such table, the holder 100 could just as well be used with other industrial machines. For example, the tool holders 100, 200, 300, 400, and 500 can be used with industrial machines configured to provide any of a variety of forming processes, such as bending, folding, and/or forming holes in sheet metal and other workpieces. Also, while the tool holders 100, 200, 300, 400, and 500 are exemplarily shown as being generally compact in size, their lengths in particular (e.g., length 106 of the holder 100) can be varied as desired (e.g., based on length of intended table and tooling application for a press brake).

Figure 2A:
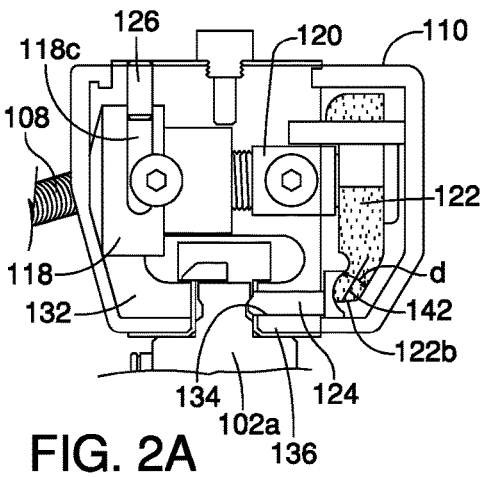
FIGS. 2A and 2B are internal side views of the tool holder of FIG. 1 showing different tang styles loaded in the holder in accordance with certain embodiments of the invention.
Figure 2B:
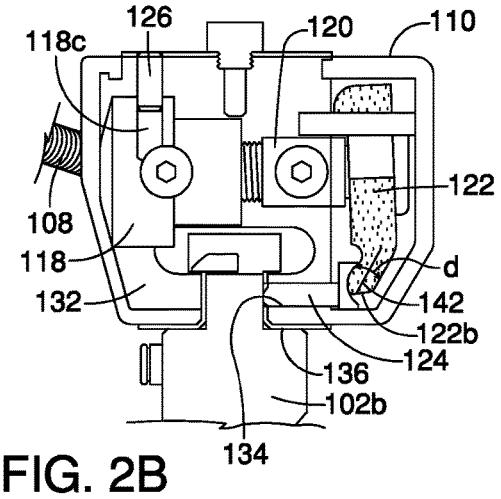

Continuing with FIG. 1 (and with reference to FIGS. 2A and 2B, showing alternate internal views), a majority of the components of the tool holder 100 are internally situated within a housing 110 of the holder 100. This is similarly depicted for the tool holder 200 of FIG. 10 (with reference to cross-sectional view of FIG. 11), the tool holder 300 of FIG. 14 (with reference to cross-sectional view of FIG. 15), the tool holder 400 of FIG. 19 (with reference to internal view of FIG. 20), and the tool holder 500 of FIG. 22 (with reference to cross-sectional view of FIG. 23). As such, these internalized components of the holders are not only generally protected from general contaminants from the work surroundings, but also configured for standard use without requiring alteration by operator.

Figure 22:
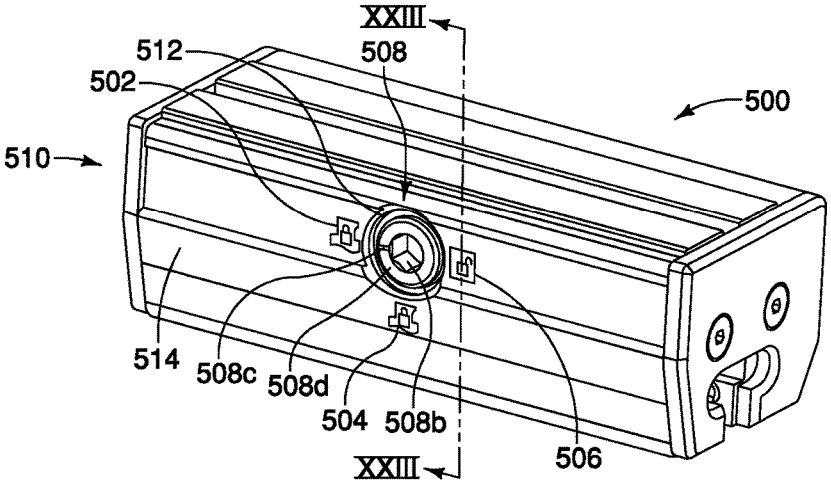
FIG. 22 is a perspective view of another tool holder in accordance with certain embodiments of the invention.

As described above, non-mechanical sources (e.g., hydraulic, pneumatic, electrical, or other like means) have often been implemented with tool holder designs to precisely regulate their actuation. However, use of such sources has also typically resulted in enhanced complexity and/or cost for the system. In contrast to such systems, the tool holders 100, 200, 300, 400, and 500 embodied herein can be mechanically actuated. Particularly, for each of the tool holders 100, 200, 300, 400, and 500, an actuator mechanism is provided and exposed through the tool holder housing, thereby being accessible to an operator. For instance, with reference back to the tool holder 100 of FIG. 1, a handle or arm 108 extends from the housing 110. Similarly, the tool holders 300 of FIG. 14 and 500 of FIG. 22 show clutch mechanism 308 and threaded insert 508, respectively, being exposed, while the tool holder 400 of FIG. 19 shows handle or arm 408 used in conjunction with transfer screw 409, with each being exposed.

Figure 10:
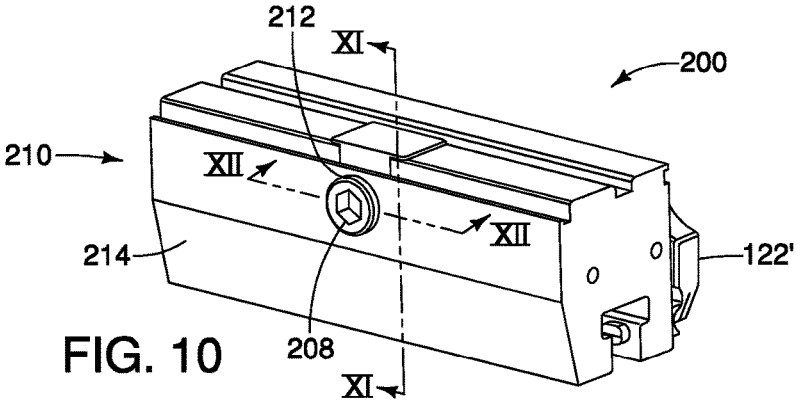
FIG. 10 is a perspective view of an additional tool holder in accordance with certain embodiments of the invention.

Turning to the tool assembly 200 of FIG. 10, while a torque screw mechanism 208 is shown as being exposed through the tool holder housing 210, unlike the other configurations described herein, additional components (e.g., clamp plate 122') are further shown as exposed and thus accessible to the operator. To that end, if certain components of the tool holders dictate periodic visual inspection or maintenance thereto, the housing design can be correspondingly altered. Nevertheless, while the tool holder 200 exemplarily depicts such an alternate design, its housing 210 could just as well be provided similar to the housing 310 of tool holder 300 (or housing 510 of tool holder 500), whereby the clamp plate 122" is provided within the housing (as should be ascertained when comparing FIGS. 11 and 15 or 23). Likewise, while not shown, it should also be appreciated that the housing design of the tool holders 100, 300, 400, and 500 could be alternatively configured, e.g., similar to housing design of tool holder 200.

As described above, the tool holders 100, 200, 300, 400, and 500 can each be configured to be mechanically actuated. Such mechanical actuation, in certain embodiments, stems from an actuator mechanism being provided with the tool holders and made accessible so as to be manually adjusted. To that end, in certain embodiments, the actuator mechanisms are configured to be adjusted via operator action. In cases of securing a tool within the tool holders, in certain embodiments, the manual adjustment made to the actuator mechanism is performable in a singular step or action. As will be further described herein, use of the actuator mechanism enables tools to be secured within the holders, while also providing the clamping pressure warranted for the tool tang style being used. In certain embodiments, the magnitude of such pressure resulting from use of the actuating mechanism is not only provided to secure tools within the holders, but also correspondingly regulated at the point of the actuator mechanism so as to minimize risk of damage to the tool and/or the tool holder.

With the above description serving as a backdrop, focus is turned back to the tool holder 100 of FIG. 1. As already noted above, the tool holder 100 involves a housing 110 with a majority of the components of the holder 100 being held therein. For actuation of the tool holder 100, the arm 108 is used, and is shown extending from a bore 112 defined in the housing 110 (e.g., in front housing wall 114). As already described, FIGS. 2A and 2B show internal side views of the tool holder 100, specifically showing tools with different tang styles secured thereto (with grooved style 102*a* being illustrated in FIG. 2A, and straight style 102*b* being illustrated in FIG. 2B). The views show the holder 100 with side face plate 116 of the housing 110 removed, and, as further detailed below, depict positions of the components contained within the housing 110 based on different positions of the arm 108 (partially shown in each of FIGS. 2A and 2B). In certain embodiments, the internal components include a clamping nut 118, a clamping bolt 120, a clamp plate 122, and one or more clamping fingers 124. Such internal components, when collectively referenced herein moving forward, are denoted as the clamping assembly 130 (see FIG. 4, separately showing the assembly 130), and can further include the actuator mechanism, e.g., the arm 108 of holder 100.

Figure 13:
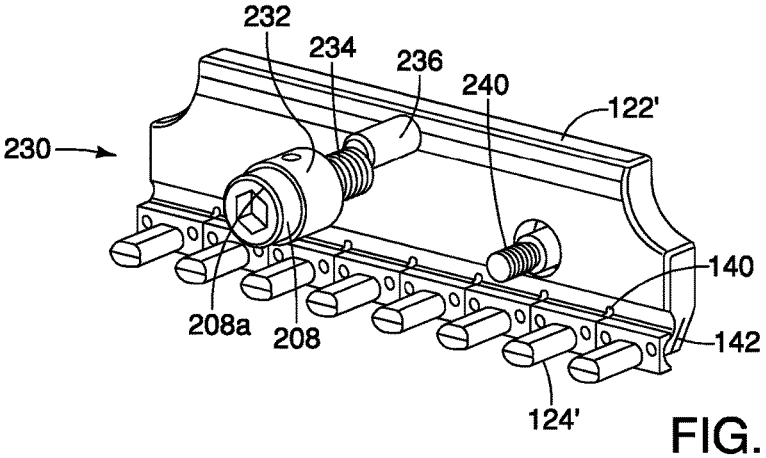
FIG. 13 is a perspective view of clamp assembly of the tool holder of FIG. 10 in accordance with certain embodiments of the invention.
Figure 14:
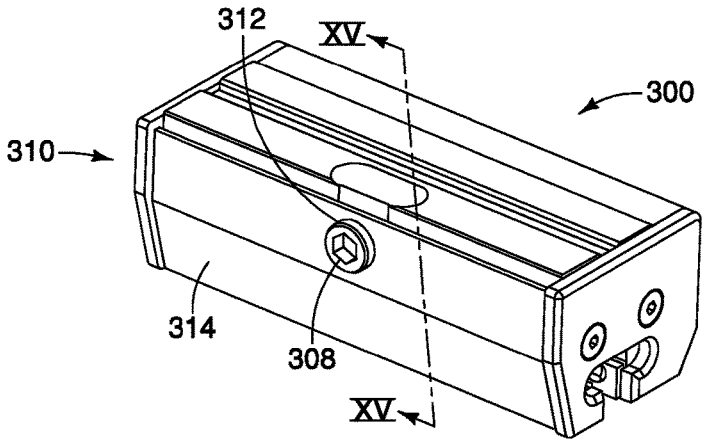
FIG. 14 is a perspective view of another tool holder in accordance with certain embodiments of the invention.
Figure 18:
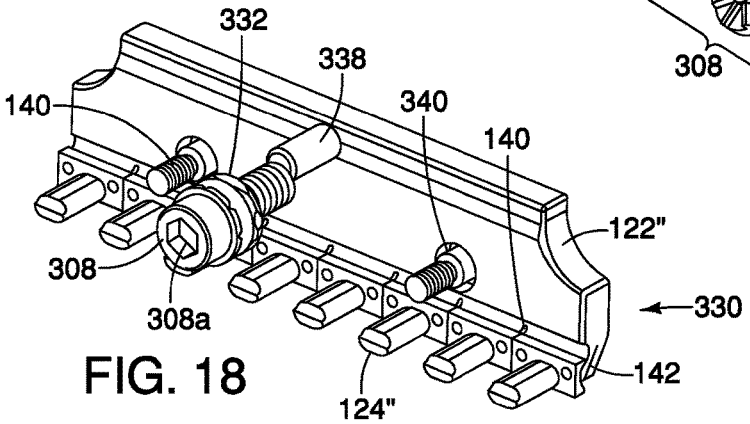
FIG. 18 is a perspective view of clamp assembly of FIG. 14 in accordance with certain embodiments of the invention.
Figure 25:
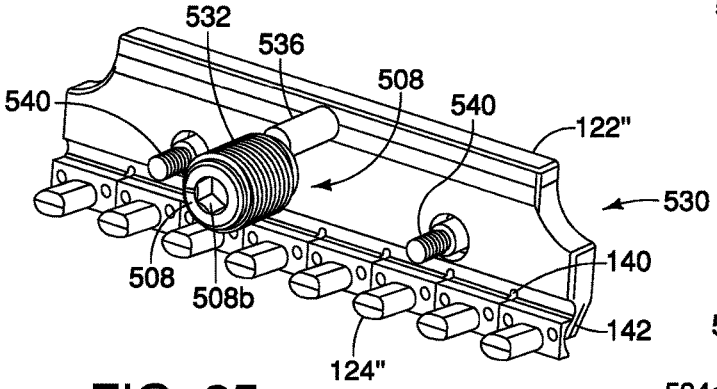
FIG. 25 is a perspective view of clamp assembly of FIG. 22 in accordance with certain embodiments of the invention.

Similar to the tool holder 100 of FIG. 1, each of the tool holders 200 of FIG. 10, 300 of FIG. 14, 400 of FIG. 19, and 500 of FIG. 22 are configured with a mechanically-based clamping assembly: assembly 230 as shown in FIG. 13, assembly 330 as shown in FIG. 18, assembly 430 as shown in FIG. 21, and assembly 530 as shown in FIG. 25, respectively. As will be further described herein, the clamp assemblies 130, 230, 330, 430, and 530 have their own structural distinctions; however, each includes a clamp plate and one or more clamping fingers. To that end, given manual adjustment of the actuator mechanisms of these tool holders, the positioning of the clamp plates is correspondingly varied in concert with the one or more clamping fingers to secure/release tools having different tang styles to/from the holders. In certain embodiments, different adjustments of the actuator mechanisms are respectively needed for each tool having a different tang style. However, in other embodiments, the same adjustment can be dictated for the actuator mechanisms regardless of tool tang style.

Figure 6:
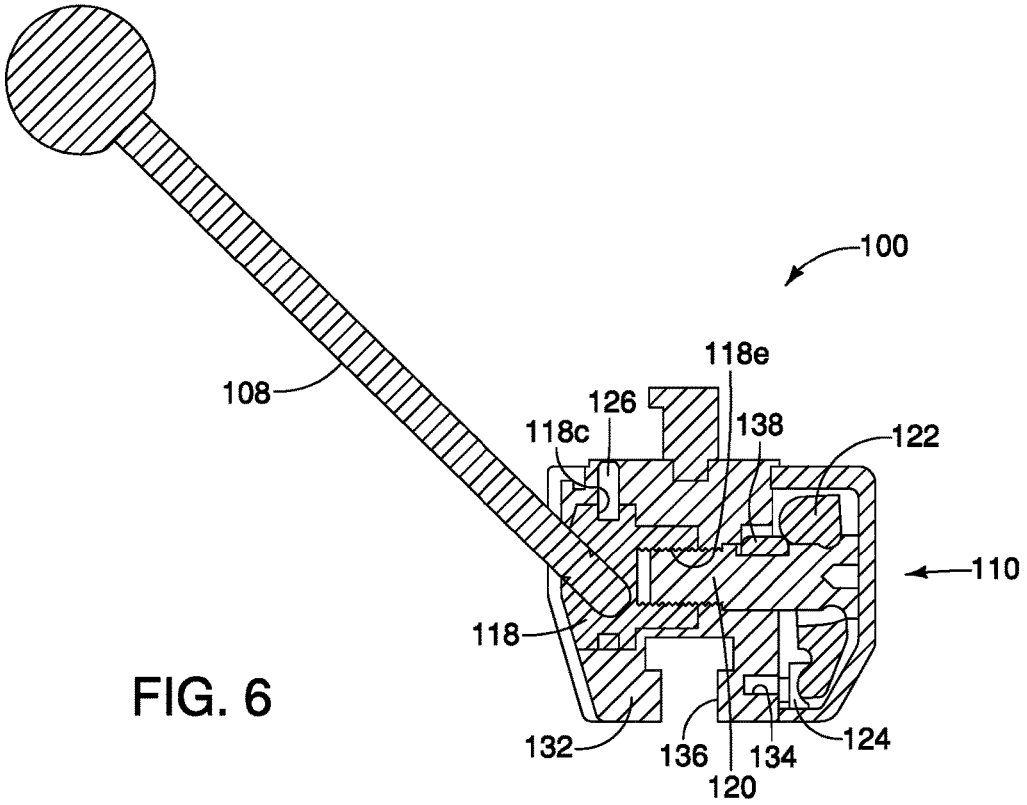
FIG. 6 is a cross-sectional view of the tool holder of FIG. 3 taken along the lines VI-VI.

With reference back to tool holder 100, FIG. 3 shows a front view of the tool holder 100, which depicts range of motion (or adjustment) for the arm 108 in accordance with certain embodiments of the invention. To that end, the arm 108 is configured for rotation relative to the housing 110 of the holder 100. With reference to FIG. 4, the arm 108 is operably coupled to the clamping nut 118 so that the arm 108 and nut 118 correspondingly rotate together. FIGS. 5A, 5B, and 5C illustrate side, cross-sectional, and perspective views of the clamping nut 118. With reference to FIG. 5A (and FIG. 6, showing cross-sectional view of tool holder 100), in certain embodiments, the coupled end of the actuator arm 108 is received within corresponding bore 118*a* defined in head 118*b* of the clamping nut 118. Further (and with reference to FIG. 4), the bore 118*a*, in certain embodiments, has elongated shape such that the actuator arm 108 can be further angled (toward the housing 110) in order to create a levered structure in rotating the arm 108 about the housing 110.

With reference back to FIG. 3, in certain embodiments, the rotation of the actuator arm 108 and the clamping nut 118, collectively, is limited to a range of not more than 180°. Turning back to FIGS. 2A/2B, the limited range of rotation for the arm 108, in certain embodiments, is based on cooperation of stop pin 126 rigidly held within housing 110 and channel 118*c* defined in outer circumference of the clamping nut head 118*b*. Particularly, the pin 126 is aligned to extend into channel 118*c*, whereby the rotation of the nut 118 is limited to the channel's extent. With reference to FIGS. 5A-5C, the channel 118*c* of the clamping pin 118 is perhaps most clearly depicted. Particularly, FIG. 5C shows initial orientation of clumping nut 118 as provided in the housing 110 when arm 108 is in starting position A (see FIG. 3). As further shown in FIGS. 5A and 5B, the channel 118*c*, in certain embodiments, extends no more than 180° about the outer circumference of the clamping nut head 118*b*, thus correspondingly limiting rotation of both the clamping nut 118 and the arm 108 to such range.

Along the range of rotation of the arm 108, in certain embodiments, there are multiple stop points for the arm 108 (e.g., defined in channel 118*c* via corresponding detents 118*d*; although, corresponding binding force between fingers 124 and tang styles, along with gravitational force on arm 108, at such points can be sufficient without use of detents). In certain embodiments, these stop points correspond to the quantity of differing tang styles the holder 100 is configured to accommodate. Looking back to FIG. 3, the arm 108 and nut 118 are shown to have at least two set stopping points, one point 128*a* with regard to straight style tangs 102*b* (as depicted in FIG. 2*b*) and another point 128*b* with regard to grooved style tangs 102*a* (as depicted in FIG. 2*a*). With reference to FIGS. 2A, 2B, and 3, when the arm 108 is moved in clockwise manner (starting from point A), the clamp plate 122, and correspondingly, the one or more clamping fingers 124, of the clamping assembly 130 are traversed inward of the holder 100 to requisite extent with respect to far wall 132 of the housing 110. Particularly, the stopping points 128*a* and 128*b* along the range of rotation correspond with the extents by which the one or more clamping fingers 124 are made to project from corresponding bores 134 defined in near wall 136 for securing the differing tang styles 102*b* and 102*a*, respectively, when loaded between walls 132, 136.

Turning back to clamping assembly 130 of FIG. 4, the clamping nut 118 is adjustably coupled to the clamping bolt 120, and the clamping bolt 120 is in turn operably coupled to the clamp plate 122. In certain embodiments (and with further reference to perspective view of clamping nut 118 shown in FIG. 5C), the clamping nut 118 is defined with threaded bore 118*e* opposite its head 118*b*, configured to threadedly receive an end of clamping bolt 120, as shown in cross-sectional view of tool holder 100 of FIG. 6. Continuing with reference to FIGS. 4 and 6, the bolt 120 is held rotationally stationary via contact with an orientation pin 138 rigidly held within the housing 110. Thus, when the arm 108 is rotated from initial point A to one of the stopping points 128*a* or 128*b*, the clamping nut 118 correspondingly rotates about the bolt 120. However, because the bolt 120 is rotationally held, the bolt 120 correspondingly moves inward of the nut 118.

Figure 7:
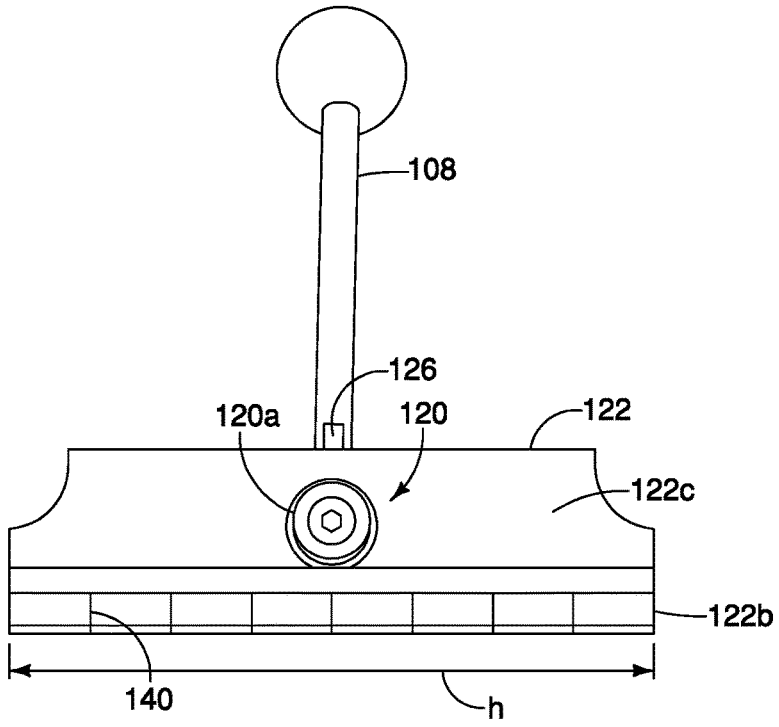
FIG. 7 is a rearward view of the clamp assembly of FIG. 4.
Figure 8:
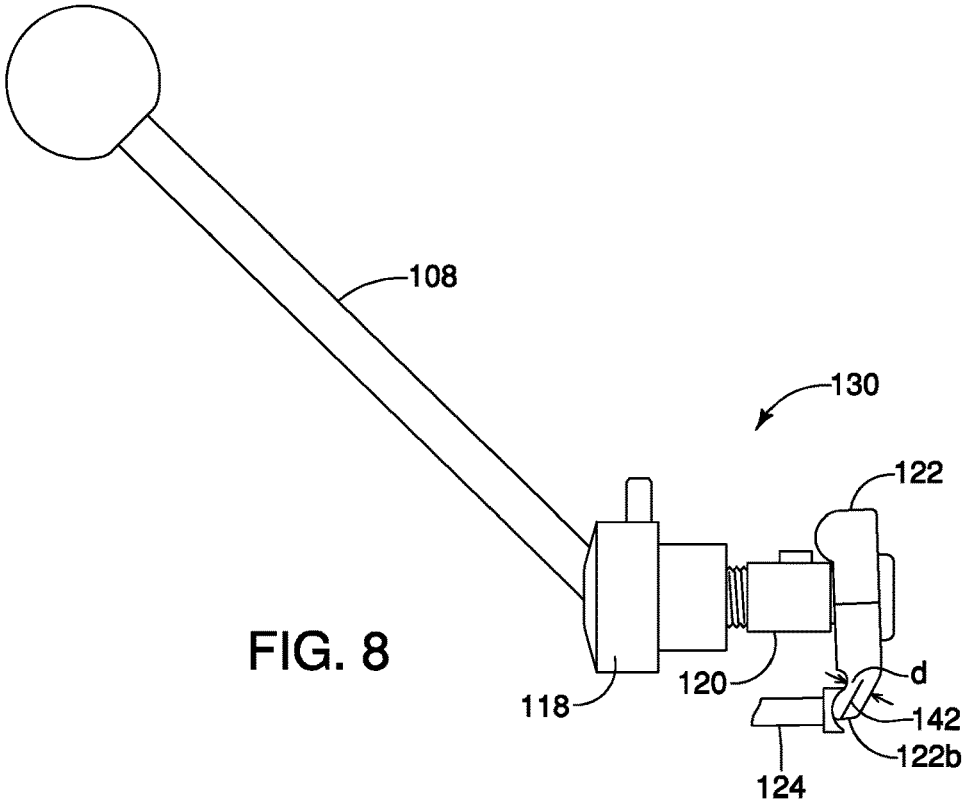
FIG. 8 is a side view of the clamp assembly of FIG. 4.

Continuing with reference to FIGS. 4 and 6, in certain embodiments as shown, the clamping bolt 120 extends through a bore 122*e* defined in the clamp plate 122, with head 120*a* of the bolt 120 positioned at rear side 122*c* of the plate 122 (shown in FIG. 7). Thus, rotation of the arm 108 toward stopping points 128*a* or 128*b* results in corresponding rotation of the clamping nut 118, which results in corresponding receipt of clamping bolt 120 within the nut 118 and inward pull of the clamp plate 122. Such inward pull of the clamp plate 122 triggers corresponding protrusion of the one or more clamping fingers 124 toward tool tang loaded between tool holder walls 132, 136. With reference back to FIG. 3, greater rotation of the arm 108 corresponds to greater projection of the fingers 124. Thus, with the fingers 124 needing to protrude further to contact grooved style tangs, greater rotation of the arm 108 (to stopping point 128*b*) is warranted, while a lesser rotation of the arm 108 (to stopping point 128*a*) is comparatively needed for fingers 124 to contact straight style tangs.

Of course, for releasing the differing tang styles of loaded tools from the tool holder 100, the arm 108 is correspondingly rotated counterclockwise back to starting point A from either of stopping points 128*a* or 128*b*. To that end, such rotation of the arm 108 results in corresponding rotation of the clamping nut 118, which results in corresponding withdrawal of portion of clamping bolt 120 from the nut 118 and outward extension of its head 120*a*, which results in corresponding outward movement of the clamp plate 122 and in turn corresponding retraction of the fingers 124 from channel of the tool holder 100 back into corresponding bores 134 of near wall 136.

As described above, built-in tolerance is considered in the design of tool holders, and such consideration is not lost in the embodied tool holder designs. The tolerance areas of the tool holders 100 of FIG. 1, 200 of FIG. 10, 300 of FIG. 14, 400 of FIG. 19, and 500 of FIG. 22 are configured with same tolerance areas due to common use of clamp plate and one or more clamping fingers in their clamp assemblies. To that end, it has been determined for the tool holder designs embodied herein that by introducing areas of tolerance both in line with force being applied to the clamping fingers 124 (along horizontal extent of the contacting end 122*b* of the clamp plate 122) and transverse (or crosswise) to such force (within depth of contacting end 122*b* of the clamp plate 122), there is enhanced tolerance gleaned from the designs. For example, there is virtually no degree of freedom or play between clamping portion(s) of tool holder 100 and tools secured therein. To that end, this complementing of tolerances functions particularly well with use of differing tang styles. One rationale for this is because such tolerances areas, via their close proximities to each other and their focus on differing (e.g., transverse) planes relative to the applied forces, are better matched for collective function.

Figure 9A:
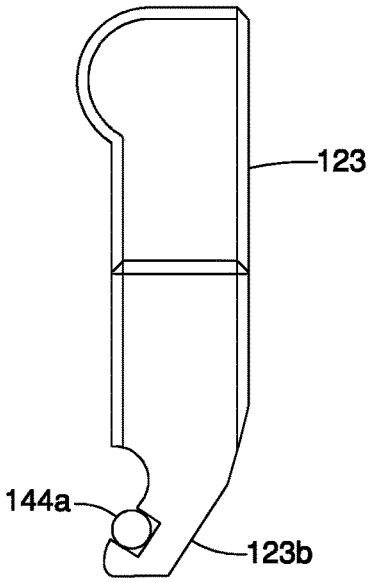
FIGS. 9A and 9B are side views of alternate clamp plates usable with the clamp assembly of FIG. 4 in accordance with certain embodiments of the invention.
Figure 9B:
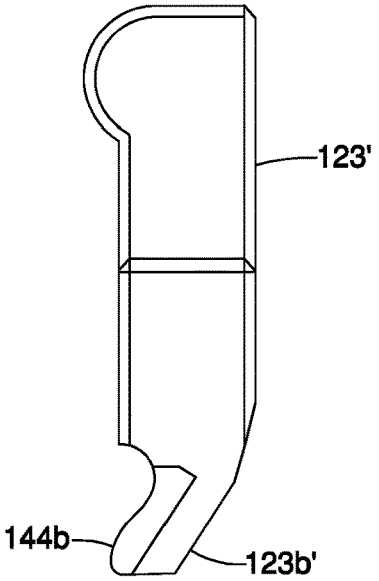

In certain embodiments, as shown in FIGS. 2A/B, 7, and 8, the areas of tolerance for the tool holder 100, and particularly, the clamp assembly 130, are provided as a plurality of slits 140 defined along horizontal extent h of the contacting end 122*b* of the clamp plate 122 (as perhaps best shown with reference to FIG. 7) and a plurality of slits 142 defined within depth d of contacting end 122*b* of the clamp plate 122 (perhaps best shown with reference to FIGS. 2A/B and 8). To that end, given their distribution on the plate 122, the slits 140, 142 are collectively actuated when subjected to forces of 400 pounds, which are common for tool—tool holder clamping forces, but not to the extent that the tolerance provided would be negligent. With reference to FIGS. 9A and 9B, further analysis has shown that the slits 142 defined within the depth d of the clamp plate 122 can be altered while still creating tolerance areas that are a sufficient match for the expected forces. To that end, in certain embodiments, alternate clamp plate configurations 123, 123' could be used, with cut portions at the clamp ends 123*b*, 123*b*' being filled with shape memory material 144*a*, 144*b*, such as urethane.

Moving on to the other tool holders 200 of FIG. 10, 300 of FIG. 14, 400 of FIG. 19 and 500 of FIG. 22, as described above, they have similar designs as compared to the tool holder 100. Particularly, they can have mechanically actuator mechanisms and can similarly include and use like-designs of clamp plates and clamping fingers. To that end, the tolerance areas of the holders 200, 300, 400, and 500 can be advantageously impacted similarly using same configuration of slits (or combination of slits and shape memory material) for the clamp plates, as has been described. As further described above, while they share similar overall function with the tool assembly 100 (i.e., to secure tools with differing tang styles, while providing warranted pressure on such tang styles), the tool holders 200, 300, 400, and 500 vary in their structure and as such have correspondingly varied manner of accomplishing such function via their clamp assemblies 230, 330, 430, and 530, respectively.

Starting with the tool holder 200 of FIG. 10, as described above, it includes a housing 210 containing a majority of the components of the holder 200. As further described, the actuation mechanism of the tool holder 200 takes the form of a torque screw mechanism 208. In certain embodiments as shown, the mechanism 208 protrudes from a bore 212 defined in the housing 210 (e.g., via a front wall 214 thereof). To that end, the mechanism 208 is configured for rotation (e.g., via Allen head as shown) relative to the housing 210 in order to mechanically actuate the holder 200. With reference to FIG. 13, the clamp assembly 230 of the tool holder 200 is formed of the mechanism 208, an internal clutch 232, a threaded insert 234, a transfer pin 236, a clamp plate 122', and one or more clamping fingers 124'. As will be understood when comparing with the tool holder 100 of FIG. 1, the clamp assembly 230 of the tool holder 200 is reliant on the magnitude of actuating force applied to the actuator mechanism rather than the styles of tangs used therewith.

Figure 11:
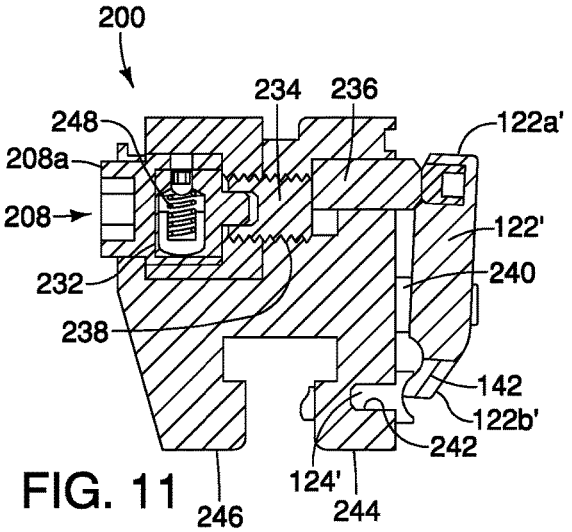
FIG. 11 is a cross-sectional view of the tool holder of FIG. 10 taken along the lines XI-XI in accordance with certain embodiments of the invention.

With reference to FIG. 11, the internal clutch 232 is operably joined to the torque screw mechanism 208 under normal loading. As such, the mechanism 208 and clutch 232 are configured to turn together. As shown, the clutch 232 is further linked to threaded insert 234, such that when the clutch 232 rotates, the threaded insert 234 is moved outward along internal threading 238. Given this outward movement of the insert 234, the transfer pin 236 is correspondingly moved outward (via end-to-end contact with the insert 234). As shown, outward movement of the transfer pin 236 results in corresponding outward movement with an end 122*a*' of the clamp plate 122' opposite the plate end 122*b*' contacting the clamping fingers 124'. Such outward deflection of the plate end 122*a*' results in the plate 122' pivoting about one or more bolts 240, such that opposing clutch plate end 122*b*' engages the clamping fingers 124', causing them to project out from corresponding bores 242 defined in near wall 244 of holder 200 for securing loaded tool tang against opposite wall 246 of holder 200.

Figure 12:
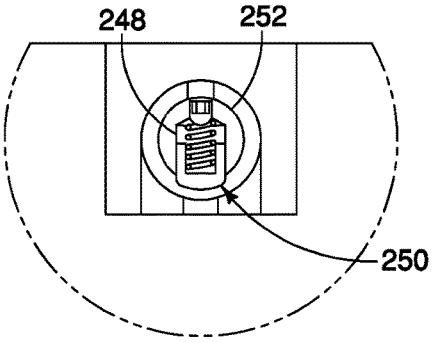
FIG. 12 is a cross-sectional view of partial portion of the tool holder of FIG. 10 taken along the lines XII-XII in accordance with certain embodiments of the invention.

Turning to FIG. 12 (and with reference to FIG. 11), under intended loading of head 208*a* of the torque screw mechanism 208, the internal clutch 232 is held thereto via clutch pin 248 extending into pocket 250 of clutch track 252. However, in the event of higher than intended loading being applied to the head 208*a* (and thereby the mechanism 208), such as in the event of the clamping fingers 124' being brought against tool tang, the clutch pin 248 is forced out of the track pocket 248, thereby actuating the clutch 232 to disengage from the mechanism 208. Thus, the mechanism 208 is left to spin freely and unengaged. To that end, mechanism 208 is only left to be rotated in opposite fashion so as to be correspondingly reengaged by clutch 232 (via clutch pin 248), wherein reverse rotation of the clutch 232 would correspond to pulling back of the threaded insert 234, the transfer pin 236, and the clamp plate 122', with clamping fingers 124' corresponding retracting from tool for its release. Otherwise, the fingers 124' would continue to be in their protruding state, securing tool.

Moving on to the tool holder 300 of FIG. 14, as described above, it includes a housing 310 containing a majority of the components of the holder 300. As further described, the actuation mechanism of the tool holder 300 takes the form of a clutch screw 308. In certain embodiments as shown, the screw 308 protrudes from a bore 312 defined in the housing 310 (e.g., in front wall 314 thereof). To that end, the screw 308 is configured for rotation (e.g., via Allen head as shown) relative to the housing 310 in order to mechanically actuate the holder 300. With reference to FIG. 18, the clamp assembly 330 of the tool holder 300 is formed of the clutch screw 308 (more particularly, a clutch screw head 308*a*), a clutch plate 332, a clutch spring 334, a transfer screw 336, a transfer pin 338, a clamp plate 122", and one or more clamping fingers 124". As will be understood and similar to the tool holder 200 of FIG. 10, the clamp assembly 330 of the tool holder 300 functions with a torque threshold, which if exceeded, automatically disengages the head 308*a* of the clutch screw 308. Thus, the clamp assembly 330 of the tool holder 300 is reliant on the magnitude of actuating force applied to the actuator mechanism rather than styles of tangs used therewith.

Figure 15:
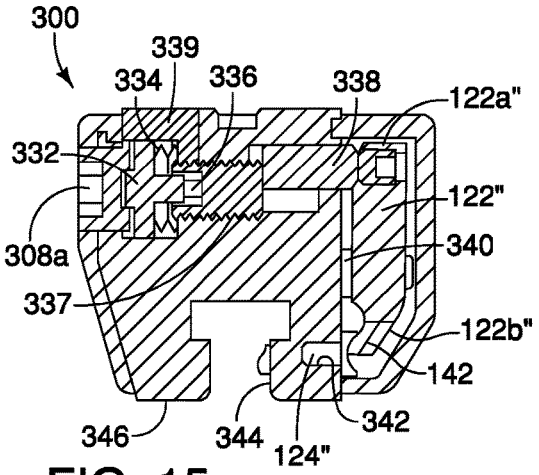
FIG. 15 is a cross-sectional view of the tool holder of FIG. 14 taken along the lines XV-XV.
Figure 17:
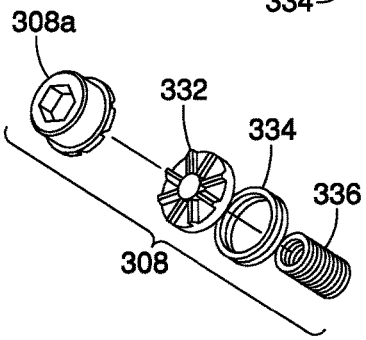
FIG. 17 is an exploded perspective view of the clutch mechanism of FIG. 16.

Much like the clamp assembly 230 of tool holder 200, the head 308*a* of the clutch screw 308 is operably configured with an assembly that comes apart upon higher than intended loading being exerted thereto (via the clutch screw's 308 actuation). Particularly, with reference to FIG. 17, under conditions of intended loading for rotation of the clutch screw 308, the screw head 308*a* is configured to act in unison with the clutch plate 332, the clutch spring 334, and the transfer screw 336. To that end, the screw head 308*a* and the clutch plate 332, under normal loading of the head 308*a*, are configured to turn together based on clutch spring 334 acting thereon in pocket 339 defined in housing 310. Turning to FIG. 15, the clutch plate 332 is linked to transfer screw 336, such that when the clutch plate 332 rotates, the transfer screw 336 is moved outward along internal threading 337. Given this outward movement of the transfer screw 336, the transfer pin 338 is correspondingly moved outward (via end-to-end contact with the screw 336). As shown, outward movement of the transfer pin 338 results in corresponding outward movement with an end 122*a*" of the clamp plate 122" opposite the plate end 122*b*" contacting the clamping fingers 124". Such outward deflection of the plate end 122*a*" results in the plate 122" pivoting about one or more bolts 340, such that opposing clutch plate end 122*b*" engages the clamping fingers 124", causing them to project out from corresponding bores 342 defined in near wall 344 of holder 300 for securing loaded tool tang against opposite wall 346 of holder 300.

Figure 16:
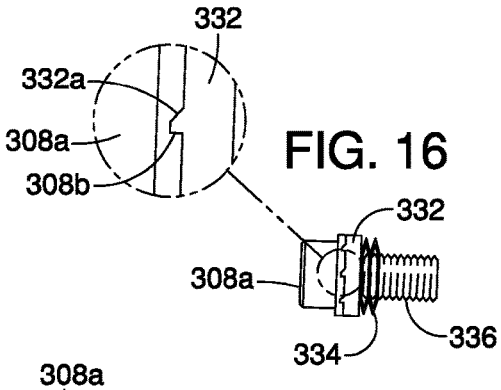
FIG. 16 is a side view of clutch mechanism (shown in FIG. 15) of the tool holder of FIG. 14, with enlarged partial view of clutch head and clutch plate being further shown.

Turning to FIGS. 15 and 16, under intended loading of the head 308*a* of the torque screw mechanism 308, the clutch plate 332 is operably joined to the head 308*a* via pressure by clutch spring 334 from confinement within housing pocket 339. However, in the event of higher than intended loading being applied to the head 308*a* (and thereby the clutch screw 308), such as in the event of the clamping fingers 124" being brought against tool tang, the clutch spring 334 will collapse, thereby allowing clutch plate teeth 332*a* to disengage with the mating recesses 308*b* defined about an underside of the head 308*a*. Once such disengagement occurs, the head 308*a* is left to spin freely and unengaged. To that end, head 308*a* is only left to be rotated in opposite fashion so as to be correspondingly reengaged with clutch plate 332 (via return to recoiled state for the clutch spring 334), wherein reverse rotation of the clutch plate 232 would correspond to pulling back of the transfer screw 336, the transfer pin 338, and the clamp plate 122", with clamping fingers 124" correspondingly retracting from tool for its release. Otherwise, the fingers 124" would continue to be in their protruding state, securing tool.

Further looking to the tool holder 400 of FIG. 19, as described above, it includes a housing 410 containing a majority of the components of the holder 400. As further described, the actuation mechanism of the tool holder 400 takes the form of a handle or arm 408 used in conjunction with transfer screw 409. In certain embodiments as shown, the arm 408 and screw 409 both protrude from corresponding slot 411 and bore 412, respectively, defined in the housing 410 (e.g., in front wall 414 thereof). To that end, the screw 409 is configured for rotation (e.g., via Allen head as shown) relative to the housing 410 in order to set the clamping system 430 for either a straight style tang (for which the screw 409 is backed from the housing 410) or a grooved style tang (for which the screw 409 is advanced into the housing 410).

Upon the transfer screw 409 being provided in the setting corresponding to the intended tang style, the arm 408 is used to mechanically actuate the holder 400. With reference to FIG. 21, the clamp assembly 430 of the tool holder 400 is formed of the arm 408, a cam cartridge 432, a cam 434, a transfer pin 436, a clamp plate 122'", and one or more clamping fingers 124'". As should be appreciated, actuation for the holder 400 via arm 408 is somewhat similar to the holder 100 of FIG. 1 as advancement of the arm 408 along range of rotation (from A to B as shown) results in the clamp plate 122'" being pushed on one end 122*a*'" so as to inwardly pivot its opposing end 122*b*'" in contact with the clamping fingers 124'", thereby moving the fingers 124'" into contact with the intended style of tang, as further detailed below.

Reference is made to FIG. 20, showing internal side view of housing 410 with its side wall 416 removed in accordance with certain embodiments of the invention. As illustrated, upon actuation (or rotation) of the arm 408, the cam 434 within the cam cartridge 432 is shifted in orientation (rotated), whereby a corresponding outer side surface of the cam 434 is brought in contact with corresponding inner wall of cam cartridge 432, thereby outwardly deflecting opposing outer wall of the cartridge 432 against the transfer pin 436. Via such contact with outer wall of cam cartridge 432, the pin 436 is correspondingly directed against clamp plate end 122*a*'" such that plate 122'" pivots about one or more bolts 438, whereby opposing clutch plate end 122*b*" deflects the clamping fingers 124'", causing them to project out from corresponding bores 440 defined in near wall 442 of holder 400 for securing loaded tool tang against opposite wall 444 of holder 400.

For releasing the differing tang styles of loaded tools from the tool holder 400, the arm 408 is correspondingly rotated back (from point B to point A). To that end, such rotation of the arm 108 results in corresponding rotation of the cam 434 to its original orientation, which results in clamp plate 122'" pivoting back to its prior position, and in turn corresponding retraction of the fingers 124'" from channel of the tool holder 400 back into corresponding bores 440 of near wall 442.

Turning to the tool holder 500 of FIG. 22, as noted herein, it has many similarities in terms of structure and corresponding functionality with the other tool holders 100, 200, 300, and 400. To that end, while the tool holder 500 has certain attributes of these other holders, the holder 500 also exhibits characteristics that are distinct and further favorable. Examples of such similarities and distinctions will be apparent from the forthcoming description concerning the holder 500.

Figure 23:
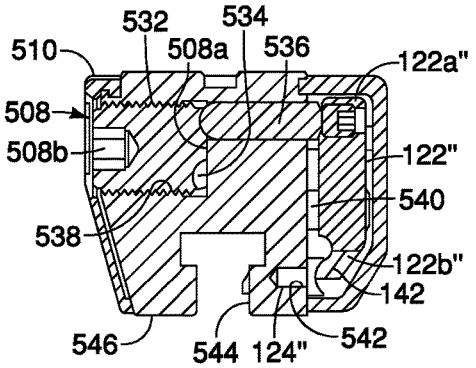
FIG. 23 is a cross-sectional view of the tool holder of FIG. 22 taken along the lines XXIII-XXIII.

With reference to FIGS. 22 and 23 (showing perspective and cross sectional views of the tool holder 500, respectively), the holder 500 includes a housing 510 which contains a majority of the holder components, similar to the tool holders 100, 200, 300, and 400. However, the tool holder 500 dictates fewer components in comparison and thus involves a simpler design. As such, the design tends to not only be less costly to manufacture but also to maintain (i.e., due to fewer components, there is reduced potential of mechanical failure). These and other favorable aspects stem from the compact yet multifunctional actuation mechanism used with the tool holder 500.

As described above, the tool holders embodied herein employ actuation mechanisms to trigger retention (or release) of tools with regard to the holders, while also providing the clamping pressure warranted for the tang style of the tool being used. In the case of the tool holder 500, the actuation mechanism involves a threaded insert 508. In certain embodiments, as further detailed below, the insert 508 forms a double helix screw. Particularly, looking to FIG. 26 (which shows the insert 508 set apart from other structure of the holder 500), a first helix can be provided via the insert's outer threading 532 (facilitating the clamping force for the holder 500). In addition, a second helix can be provided via pitched channel 534 defined at the insert's leading end 508*a* (facilitating much of the movement of the components upstream of the insert 508 for tool retention/release). As will be detailed later, the double helix design of the insert 508 enables the actuation process to be both effective and efficient.

Turning back to FIG. 22 (and with reference to FIG. 23), in certain embodiments as shown, the threaded insert 508 protrudes from a bore 512 defined in the holder housing 510 (e.g., in front wall 514 thereof). To that end, the insert 508 is configured for rotation (e.g., via Allen head 508*b*) relative to the housing 510 (e.g., within threaded boss 538 defined therein) in order to mechanically actuate the holder 500. As will be further explained herein and similar to the tool holder 100 of FIG. 1, different adjustments (rotations) of the threaded insert 508 of the tool holder 500 are correspondingly required for retaining tools having different tang styles (e.g., grooved and straight tang styles).

Continuing with the above, the threaded insert 508 is configured to be rotatable both in clockwise and counterclockwise directions relative to the housing 510. In certain embodiments, the rotation range of the insert 508 in either direction is less than 360° (or a full rotation), and, in perhaps more preferable embodiments, the range of rotation is not more than 180°. As is further detailed below, the threaded insert 508 has a plurality of positions along such rotational range which correspond to distinct settings for the tool holder 500. Looking to FIG. 22, in certain embodiments as shown, such rotatable positions of the insert 508 are correspondingly marked on the housing 510, about the periphery of the bore 512, as designations 502, 504, and 506. As described above, each designation 502, 504, and 506 is identified/associated as a corresponding setting for the tool holder 500. Particularly, the designation 502 signals a locked setting/state of the holder 500 for grooved style tangs, the designation 504 signals a locked setting/state of the holder 500 for straight style tangs, and the designation 506 signals an unlocked setting/state for the holder regardless of tool tang style.

Further to the above and with continued reference to FIG. 22, the threaded insert 508 is configured to be toggled (i.e., rotated) between such setting designations 502, 504, and 506 as is desired, depending on whether a tool is to be retained or released, and if retained, the style of the tool's tang. In certain embodiments, rotated position of the insert 508 and corresponding setting of the holder 500 are visually represented via use of indicator 508*c* (on exposed end 508*d* of insert 508) and alignment of such indicator 508*c* with desired setting designation 502, 504, and 506 on the housing 510.

Figure 24A:
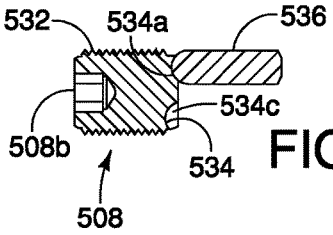
FIGS. 24A and 24B are cross-sectional views of threaded insert (similar to that shown in FIG. 23) of the tool holder of FIG. 22, in different orientations relative to transfer pin of the tool holder.
Figure 24B:
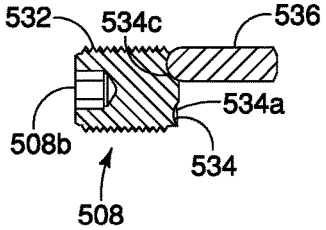

Turning to FIGS. 23, 24A, and 24B (and with further reference to FIG. 26), the range of rotation for the insert 508, in certain embodiments, can be based on linkage between a transfer pin 536 (e.g., rounded or ball end 536*a* thereof) and the pitched channel 534 defined at the insert's leading end 508*a*. For example, the pin 536 is aligned to extend into the channel 534, while the pin's vertical position is maintained within the housing 510. As such, rotational range of the insert 508 can be limited to the channel's extent (along and within which the pin 536 rides as the insert 508 is rotated). However, in certain embodiments, the channel 534/pin 536 linkage could just be one of a number of factors in defining/limiting the range of rotation of the insert 508. For example, in certain embodiments, the depth of the threaded boss 538 (in which the insert 508 is received) can also be a contributing (or even prevailing) factor in defining the rotation range of the insert 508. To that end, with reference to FIG. 23, the depth of the boss 538 could be correspondingly limited, effectively eliminating the possibility of excessive rotation of the insert 508.

Figure 26:
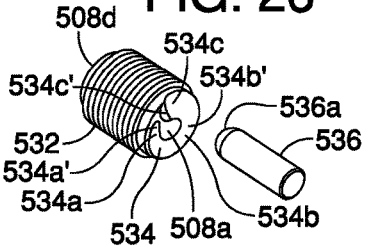
FIG. 26 is a perspective view of the threaded insert and transfer pin spaced apart from their orientation of FIG. 24B with the view showing end surface of the threaded insert defined to contact the transfer pin.

Looking to FIG. 26 (and with reference to FIGS. 24A and 24B), the channel 534 of the threaded insert 508 is illustrated. The channel 534, as shown, curves about the insert's leading end 508*a*. In certain embodiments, the channel 534, via its extent, is configured to limit rotation of the insert 508 to be no more than 180°. To that end (and with reference back to FIG. 22), the setting designations 502, 504, and 506 are correspondingly distributed about the bore 512, such that toggling of the insert indicator 508*c*, e.g., in shifting from "locked" setting designation 502 to "unlocked" setting designation 506 in counterclockwise direction (or vice versa in clockwise direction), would be provided along similar rotation angle.

Reference is made to FIG. 25, showing components of the clamp assembly 530 of the tool holder 500, and general positioning of such components. As already alluded to, the clamp assembly 530 has a limited quantity of components; particularly, the components involve the threaded insert 508, the transfer pin 536, a clamp plate 122", and one or more clamping fingers 124". As described above, and as further illustrated in FIGS. 23, 24A, and 24B, the transfer pin 536 is linked to the threaded insert 508 (via the insert's channel 534). To that end, differing rotations of the insert 508 (e.g., to setting designations 502, 504, and 506) correspond to differing lateral adjustments of the transfer pin 536 (and corresponding adjustments to the clamp plate 122", which is linked to the transfer pin 536). It should be noted that the clamp plate 122" and clamping fingers 124" have the same reference numbers as like components from the tool holder 300 of FIG. 14. To that end, each of these components are similarly configured and situated in the tool holders 300 of FIG. 14 and 500 of FIG. 22. Nevertheless, it should be appreciated that these components of the holders 300 and 500 could just as well have structural differences (e.g., such as with clamp plate 122 of tool holder 100 and clamp plate 122' of tool holder 200), yet still have similar functionality of retaining/releasing tools within the holders.

Continuing with the above, and turning to FIGS. 24A and 24B, the threaded insert 508 and transfer pin 536 are depicted in cross-sectional view (similar to that shown in FIG. 23), with the insert 508 shown in rotated positions corresponding to setting designations 502 and 506 for the tool holder 500 (with reference to FIG. 22), respectively. To that end, these settings 502 and 506 (as well as setting 504) correspond to differing adjustments of the transfer pin 536 via linkage with the threaded insert 508, particularly based on position of the pin 536 along channel 534 defined in the insert end 508*a*. As described above, the channel 534 is defined to have pitch along its extent. As should be appreciated, the pitch, and corresponding depth, of the channel 534 along its extent directly impacts the amount of adjustment of the pin 536 as the insert 508 and channel 534 are rotated, with corresponding impact on clamp plate 122" and clamping fingers 124". Generalities regarding the pitch and depth along the channel 534 can be gathered from FIGS. 24A and 24B, with reference to FIGS. 23 and 26.

Starting with reference to FIG. 24A (and FIG. 23, which shows same configuration), the insert 508 is shown in a rotated position 534*a* corresponding to setting designation 502 for the tool holder 500. As described above, setting designation 502 signals a locked setting/state of the holder 500 for grooved style tangs. At such setting, a maximum adjustment/projection of the pin 536 (via contact with the channel 534) is warranted so as to correspondingly actuate/direct the pin 536 (and clamp plate 122" and clamping fingers 124") outward to provide a locked state for grooved style tang (see FIG. 23). As such, in certain embodiments, the depth of the channel 534 in contact with the pin 536 at this rotated position of the insert 508 is at or near its minimum level (as compared to rest of the channel extent). Given the minimum depth of the channel 534 at this pin position 534*a*, in certain embodiments, the pin would be correspondingly situated at or near one end of the channel extent, and the pitch of the channel 534, starting from this pin position and moving toward opposing end of the channel extent, would be falling or declining.

Turning to FIG. 24B (and FIG. 26, which shows same configuration, but in exploded view), the insert 508 is shown in a rotated position 534*c* corresponding to setting designation 506 for the tool holder 500. As described above, setting designation 506 signals an unlocked setting/state for the holder 500 regardless of tang style. At such setting, a minimum adjustment/projection of the pin 536 (via contact with the channel 534) is warranted so as to correspondingly pull back/retract the pin 536 (and clamp plate 122" and clamping fingers 124") inward to provide an unlocked setting/state for the holder (see FIG. 27). As such, in certain embodiments, the depth of the channel 534 in contact with the pin 536 at this rotated position of the insert 508 is at or near its maximum level (as compared to rest of the channel extent). Given the maximum depth of the channel 534 at this pin position 534*c*, in certain embodiments, the pin would be correspondingly situated at or near the other end of the channel extent, and the pitch of the channel 534, starting from this pin position and moving toward opposing end of the channel extent, would be rising or inclining.

While not specifically depicted, pin position 534*b* within the channel 534 for rotated position of the threaded insert 508 corresponding to setting designation 504 is referenced in FIG. 26, and would be between the configurations depicted in FIGS. 24A and 24B. As described above, setting designation 504 signals locked setting/state of the holder 500 for straight style tangs. At such setting, if position for the pin 536 had been toggled from designation 506, the warranted adjustment for the pin 536 (from the insert 508) would involve urging it inward (along with the clamp plate 122" and clamping fingers 124") to provide a locked state for straight style tang. Conversely, if position for the pin 536 is being toggled from designation 502, the adjustment warranted would be to correspondingly pull back/retract the pin 536 (and clamp plate 122" and clamping fingers 124") inward to back off from the locked setting/state for the holder 500 for grooved style tangs. As such, in certain embodiments, the depth of the channel 534 in contact with the pin 536 at this rotated position of the insert 508 is between its maximum and minimum levels, and to that end, the pin position 534*b* would be correspondingly situated at or near the midpoint of the channel extent. The pitch at the pin position 534*b* would be falling/declining relative to pin position 534*a*, yet would be rising/inclining relative to pin position 534*c*.

Given the general pitch (and depth) characteristics described above for the channel 534, reference is now made to the outer threading 532 of the insert 508, and the favorable aspects of the double helix design of insert 508, as noted above. Regarding the outer diameter of the insert 508, due to its treading 532, it too has a pitch. To that end, the pitches of the threading 532 and channel 534 are additive, and the design would function in effective manner with regard to adjustment/movement of the transfer pin 536. In certain embodiments, the two pitches differ, particularly the insert outer diameter pitch (of the threading 532) is less than the insert end pitch (of the channel 534). In one example, the pitch of the threading 532 may be 2 mm, while the pitch of the channel 534 would be defined as greater, e.g., 3.75 mm. In such a case, the pitches again would be additive, equaling total pitch of 5.75 mm. However, due to their difference in magnitude (wherein the channel has greater pitch than outer threading of the insert), the design would function in efficient manner; that is, small rotations (inward movement) of the insert 508 would correspond to significant lateral movement of the pin 536 (and correspond with significant movements of the clamp plate 122" and clamping fingers 124").

With continued reference to FIG. 26, along the range of rotation of the insert 508, in certain embodiments, one or more stop points can be defined in channel 534 to help confine the pin 536 at those positions corresponding to one or more of the setting designations 502, 504, and 506 of the threaded insert 508. To that end, in certain embodiments, such stop points are defined at the pin positions 534*a*, 534*b*, and 536*c* already described, and are defined as corresponding detents 534*a*', 534*b*, and 534*c*' in the channel 534. Further regarding the channel 534, in certain embodiments, its width remains constant over its extent. As such, the primary parameter that is varied over the channel extent is the channel depth.

In circling back to FIG. 22, when the insert 508 is rotated in clockwise manner from "unlocked" setting designation 506, the pin 536 moves from a depth at or near maximum (at pin position 534*c*) along the channel 534 to lesser depth (either at pin position 534*b* corresponding to setting designation 504, or at pin position 534*a* corresponding to setting designation 502). Correspondingly, the transfer pin 536 is urged outward toward upper portion 122*a*" of the clamp plate 122", which causes the plate 122" to pivot about bolts 540. Thus, via corresponding inward pivoting of the lower portion 122*b*" of the plate 122", the one or more clamping fingers 124" are traversed inward of the holder 500 to requisite extent with respect to far wall 546 of the housing 510. To this end, aforementioned stop points 534*a*' and 534*b*' along the channel 534 correspond with the extents by which the one or more clamping fingers 124" are made to project from corresponding bores 542 defined in near wall 544 for securing the differing tang styles (e.g., grooved and straight), respectively, when loaded between walls 544, 546.

Figure 27:
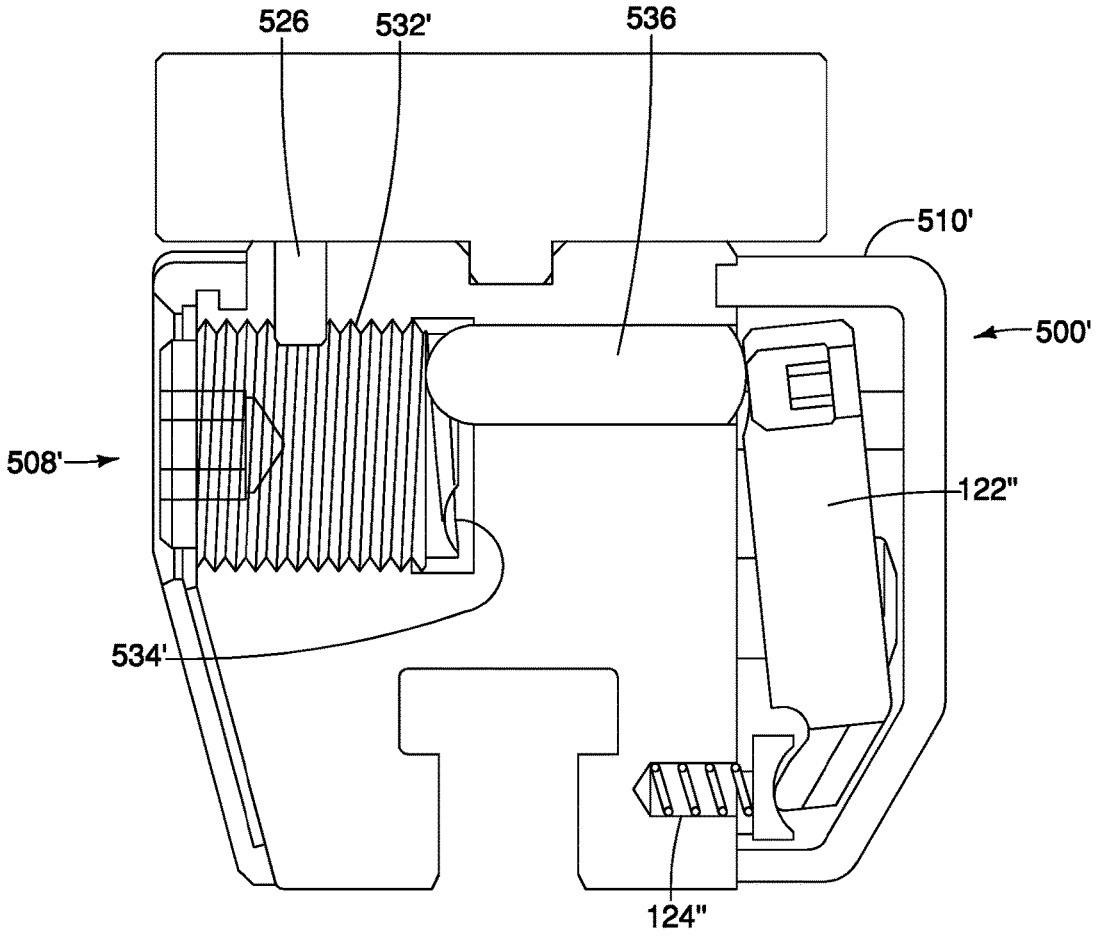
FIG. 27 is a cross-sectional view similar to that of FIG. 23 with regard to alternate version of the tool holder of FIG. 22 in accordance with certain embodiments of the invention.
Figure 28:
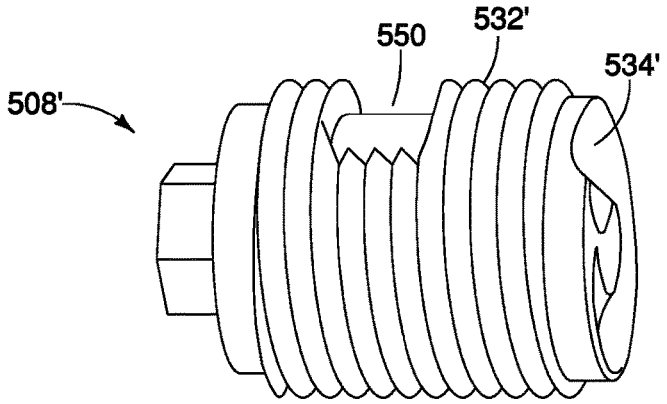
FIG. 28 is a perspective view of alternate version of threaded insert (shown in FIG. 27) of the tool holder of FIG. 27.

Turning to FIGS. 27 and 28, they are related to the tool holder 500 of FIG. 22, as their primary distinguishing element is an alternate design of threaded insert 508'. To that end, FIG. 27 is a cross-sectional view (similar to that of FIG. 23) of alternate tool holder 500' employing the alternate insert 508', while FIG. 28 shows a perspective view of the insert 508'. What should be apparent from FIG. 28 (particularly when compared to FIG. 26) is that a channel 550 is defined in the outer threading 532' of the insert 508'. Thus, the functioning of the insert 508' with respect to the holder 500' is similar to that already described for holder 500, except the range of rotation for the insert 508' is limited.

With reference to FIG. 27, a stop pin 526 is rigidly held within the holder housing 510' and the channel 550 defined in the outer circumference of the threaded insert 508' is situated so as to align with the pin 526. As such, rotation of the insert 508' is limited to the extent of the channel 550. The channel 550, in certain embodiments, can extend 180° about the outer circumference of the insert 508', thus correspondingly limiting rotation of the insert 508' to such range. As should be appreciated, use of the insert 508' is an alternate manner of keeping the rotation of the threaded insert 508 no more than 180° without as much focus on the design of the channel 534 defined in the leading end 508*a* of the insert 508. Although, the design considerations relating to the channel 534 of the insert 508 were of value in helping minimize the complexity and quantity of components for the tool holder 500.

Thus, embodiments of a TOOL HOLDER WITH MECHANICALLY-ACTUATED CLAMP ASSEMBLY AND USABLE FOR TOOLING HAVING DIFFERENT TANG STYLES are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A tool holder configured for use with tools having different tang styles, the tool holder comprising:

a housing including a stationary wall with an opening defined in the wall;

a pin that is rigidly held within the housing;

an actuator mechanism extending within the opening of the stationary wall, the mechanism having one end that is accessible at the opening and an opposing end that projects into the housing, the actuator mechanism having a channel defined in a longitudinal surface thereof within which the pin projects; and a clamp assembly being operably coupled to the housing opposite the stationary wall, the clamp assembly being pivotable and operatively linked to the actuator mechanism, whereby an inward adjustment of the actuator mechanism relative to the housing results in a pivoting of the clamp assembly toward the stationary wall to secure a tool between the clamp assembly and the stationary wall;

wherein the actuator mechanism is adjustable in the opening to a plurality of inward positions relative to the housing, each of the positions corresponding to a different setting for the pin within the channel and resulting in a different pivoted configuration of the clamping assembly relative to the stationary wall, adjustment of the actuator mechanism being limited to extent by which the channel of the mechanism is correspondingly moveable relative to the pin.

2. The tool holder of claim 1 wherein the clamp assembly comprises a plurality of clamping fingers which are pivotable relative to the stationary wall, wherein the actuator mechanism and fingers are respectively positioned at upper and lower corners of opposing sides of the housing.

3. The tool holder of claim 1 wherein the actuator mechanism is adjustable via rotation in both clockwise and counterclockwise directions, the rotation of the mechanism in one of the directions corresponding to movement of the clamp assembly inward relative to the housing and the rotation of the mechanism in other of the directions corresponding to movement of the clamp assembly outward relative to the housing.

4. The tool holder of claim 1 wherein the actuator mechanism is adjustable via rotation, and wherein the channel of the mechanism is defined about a longitudinal axis of the mechanism so as to be correspondingly rotatable about the pin.

5. The tool holder of claim 4 wherein the mechanism is a threaded insert, and the opening defined in the stationary wall of the housing is correspondingly threaded to receive and allow for rotatable adjustment of the insert therein.

6. The tool holder of claim 5 wherein the accessible end of the insert is formed of an Allen head.

7. The tool holder of claim 4 wherein the channel of the mechanism extends about the mechanism by no more than about one-half of a circumference of the mechanism such that the mechanism has a range of rotation of not greater than 180° relative to the housing.

8. The tool holder of claim 4 wherein the channel of the mechanism is defined with stop points along an extent of the channel, the stop points corresponding to different positions at which the channel is temporarily held relative to the pin and further corresponding to the different pivoted configurations of the clamp assembly.

9. The tool holder of claim 8 wherein the housing has a plurality of designations distributed about a periphery of the opening, each of the designations corresponding to one of the stop points.

10. The tool holder of claim 9 wherein the accessible end of the actuator mechanism is provided with an indicator, wherein rotation of the mechanism such that the pin is positioned at one of the stop points of the channel corresponds to one of the pivoted configurations for the clamp assembly and the indicator being aligned with a corresponding one of the designations for such stop point.

11. The tool holder of claim 1 wherein a further channel is defined at the opposing end of the mechanism and a further pin is contained within the housing and extends from the further channel, the further channel having a pitched extent and being movable relative to the further pin, whereby the clamping fingers are moved toward the stationary wall when the mechanism is rotated such that the further pin moves upward along the pitched extent and whereby the clamping fingers are moved away from the stationary wall when the mechanism is reversibly rotated such that the further pin moves downward along the pitched extent.

12. The tool holder of claim 11 wherein the further channel has a greater pitch than an outer threading of the mechanism, whereby rotation of the mechanism results in greater inward or outward movements of the further pin along the further channel.

13. A tool holder configured for use with tools having different tang styles, the tool holder comprising:

a housing including a stationary wall with a threaded opening defined in the wall;

a threaded insert received within the opening of the stationary wall, the mechanism having one end that is accessible at the opening and an opposing end that projects into the housing, the actuator mechanism having a pitched channel defined in the opposing end;

a clamp assembly being operably coupled to the housing opposite the stationary wall, the clamp assembly being pivotable and linked to the actuator mechanism, whereby an inward adjustment of the actuator mechanism relative to the housing results in a pivoting of the clamp assembly toward the stationary wall to secure a tool between the clamp assembly and the stationary wall; and a pin contained within the housing that links the opposing end of the threaded insert to the clamp assembly, one end of the pin being received by the channel defined in the opposing end of the threaded insert and an opposing end of the pin contacting the clamp assembly;

wherein the insert is rotatable in the opening to a plurality of inward positions relative to the housing, each of the positions corresponding to a different setting for the along the pitched channel and resulting in a different pivoted configuration of the clamp assembly relative to the stationary wall.

14. The tool holder of claim 13 wherein the range of rotation of the insert is based on a further channel defined in a longitudinal surface of the insert and a further pin contained within the housing and received by the further channel, wherein the insert is rotatable about the further pin along an extent of the further channel.

15. The tool holder of claim 13 wherein the channel has greater pitch than an outer threading of the insert, whereby rotation of the insert results in greater inward or outward movements of the pin along the channel.

16. The tool holder of claim 1 wherein the clamp assembly includes a first portion and a second portion, the first portion being linked to the actuator mechanism, whereby an inward adjustment of the actuator mechanism relative to the housing results in an outward pivoting of the first portion and corresponding inward pivoting of the second portion toward the stationary wall.

17. The tool holder of claim 11 wherein the clamp assembly includes a first portion and a second portion, the first portion being linked to the actuator mechanism, whereby an inward adjustment of the actuator mechanism relative to the housing results in an outward pivoting of the first portion and corresponding inward pivoting of the second portion toward the stationary wall.

18. The tool holder of claim 17 wherein the further pin links the opposing end of the insert to the first portion of the clamp assembly, one end of the further pin being received by the further channel defined in the opposing end of the insert and an opposing end of the further pin contacting the first portion of the clamp assembly.

19. The tool holder of claim 13 wherein the clamp assembly includes a first portion and a second portion, the first portion being linked to the insert, whereby an inward adjustment of the insert relative to the housing results in an outward pivoting of the first portion and corresponding inward pivoting of the second portion toward the stationary wall.

20. The tool holder of claim 19 wherein the pin links the opposing end of the insert to the first portion of the clamp assembly, one end of the pin being received by the channel defined in the opposing end of the insert and an opposing end of the pin contacting the first portion of the clamp assembly.

* * * * *